US008096290B2

(12) United States Patent
Karlsson

(10) Patent No.: US 8,096,290 B2
(45) Date of Patent: Jan. 17, 2012

(54) DEVICE FOR AN INTERNAL COMBUSTION ENGINE

(76) Inventor: Karl-Gunnar Karlsson, Skovde (SE)

( * ) Notice: Subject to any disclaimer, the term of this patent is extended or adjusted under 35 U.S.C. 154(b) by 0 days.

(21) Appl. No.: 10/540,915

(22) PCT Filed: Dec. 29, 2003

(86) PCT No.: PCT/SE03/02078

§ 371 (c)(1),
(2), (4) Date: Oct. 6, 2005

(87) PCT Pub. No.: WO2004/061277

PCT Pub. Date: Jul. 22, 2004

(65) Prior Publication Data

US 2006/0086344 A1 Apr. 27, 2006

(30) Foreign Application Priority Data

Jan. 2, 2003 (SE) ..... 0300004

(51) Int. Cl.
*F01M 13/00* (2006.01)

(52) U.S. Cl. ..... 123/572

(58) Field of Classification Search ..... 123/572–574, 123/41.86
See application file for complete search history.

(56) References Cited

U.S. PATENT DOCUMENTS

| | | | | |
|---|---|---|---|---|
| 4,082,071 | A * | 4/1978 | Jones | 123/573 |
| 4,136,650 | A * | 1/1979 | Manookian, Jr. | 123/573 |
| 4,409,950 | A * | 10/1983 | Goldberg | 123/573 |
| 5,429,101 | A * | 7/1995 | Uebelhoer et al. | 123/572 |
| 5,586,996 | A * | 12/1996 | Manookian, Jr. | 55/321 |
| 5,709,477 | A * | 1/1998 | Schinasi et al. | 383/4 |
| 6,047,670 | A | 4/2000 | Stella et al. | |
| 6,152,120 | A * | 11/2000 | Julazadeh | 123/572 |
| 6,161,529 | A * | 12/2000 | Burgess | 123/572 |
| 6,345,614 | B1 * | 2/2002 | Shureb | 123/572 |
| 6,354,283 | B1 * | 3/2002 | Hawkins et al. | 123/572 |
| 6,422,224 | B1 * | 7/2002 | Walker, Jr. | 123/572 |
| 6,557,536 | B2 * | 5/2003 | Burgess | 123/572 |
| 6,647,973 | B1 * | 11/2003 | Schueler et al. | 123/572 |
| 6,723,149 | B2 * | 4/2004 | Ernst et al. | 55/498 |
| 6,858,051 | B2 * | 2/2005 | Uhlenbrock | 55/321 |
| 2002/0187703 | A1 * | 12/2002 | Pearce et al. | 442/408 |
| 2003/0101701 | A1 * | 6/2003 | Henrichsen et al. | 55/523 |
| 2005/0092309 | A1 * | 5/2005 | Bedkowski et al. | 123/572 |

* cited by examiner

*Primary Examiner* — M. McMahon
(74) *Attorney, Agent, or Firm* — Dennison, Schultz & MacDonald

(57) ABSTRACT

In an internal combustion engine, contaminated air in the crankcase creates problems. As a rule, the contaminated air is led into the engine's inlet manifold, and this can disrupt the smooth running of the engine. The invention eliminates the problem by having a filter connected to the crankcase, such that contaminated air from the crankcase must pass through this filter, where it is freed of its contaminants.

10 Claims, 2 Drawing Sheets

DEVICE FOR AN INTERNAL COMBUSTION ENGINE

This application is a filing under 35 USC 371 of PCT/SE2003/002078 filed Dec. 29, 2003.

BACKGROUND OF THE INVENTION

The present invention is for use with an internal combustion engine. In such engines, the air in the crankcase builds up a certain overpressure and must be released. However, release may not be in any way whatsoever. The air must first be cleaned. Up until now, cleaning has been by attempting to combust the contaminated crankcase air after it has been led from the crankcase back into the engine's inlet manifold. However, this has had certain disadvantages for the engine. Carbon coating is one example of such a disadvantage.

SUMMARY OF THE INVENTION

The purpose of the present invention is to eliminate these disadvantages by connecting a filter unit to the crankcase. The air from the crankcase has to pass through this filter unit, which separates contaminants from the air. The air thus cleaned by the filter unit is fed into, for example, the engine's inlet manifold. The undesirable particles filtered from the crankcase air can be led back to the crankcase. It is, of course, also possible to further filter the particles so that carbon particles and oil are separated. In this way, carbon particles could be separated and only the oil returned to the crankcase. In passing through the filter, it is possible for individual carbon particles to fuse into larger particles that are easily separated. Various types of filter can be used in the filter unit. It has, however, proven particularly advantageous to have fibre mats for the filter walls, the diameter of the fibres in the walls varying between 1 and 40 μm. The fibres may be thermally bonded to each other or bonded by needling. A particularly suitable construction of the filter is for it to have a body with a top face and a bottom face. The body is suitably positioned more or less vertical, or at a certain angle, to the internal combustion engine. In the vertical position, it is appropriate for air from the crankcase to be fed into the top of the body and for the body to house vertical walls of a fibrous mass, through which the air has to pass transversally. Cleaned air can then be taken from the top of the body. Under the influence of gravity, the separated particles fall to the bottom of the body. At the bottom of the body, there is a drainage opening. As a rule, this is connected to the crankcase. When this facilitates the separated particles falling to the bottom, it has proven advantageous to have the body at an angle to the internal combustion engine. The circumference of the body can have any shape whatsoever. It has proven that it can be practical for the body to have a quadratic cross section or an entirely circular cross section.

BRIEF DESCRIPTION OF THE DRAWINGS

The present invention is more closely described in the following examination of the attached drawings where.

DESCRIPTION OF THE PREFERRED EMBODIMENTS

Figure 1:
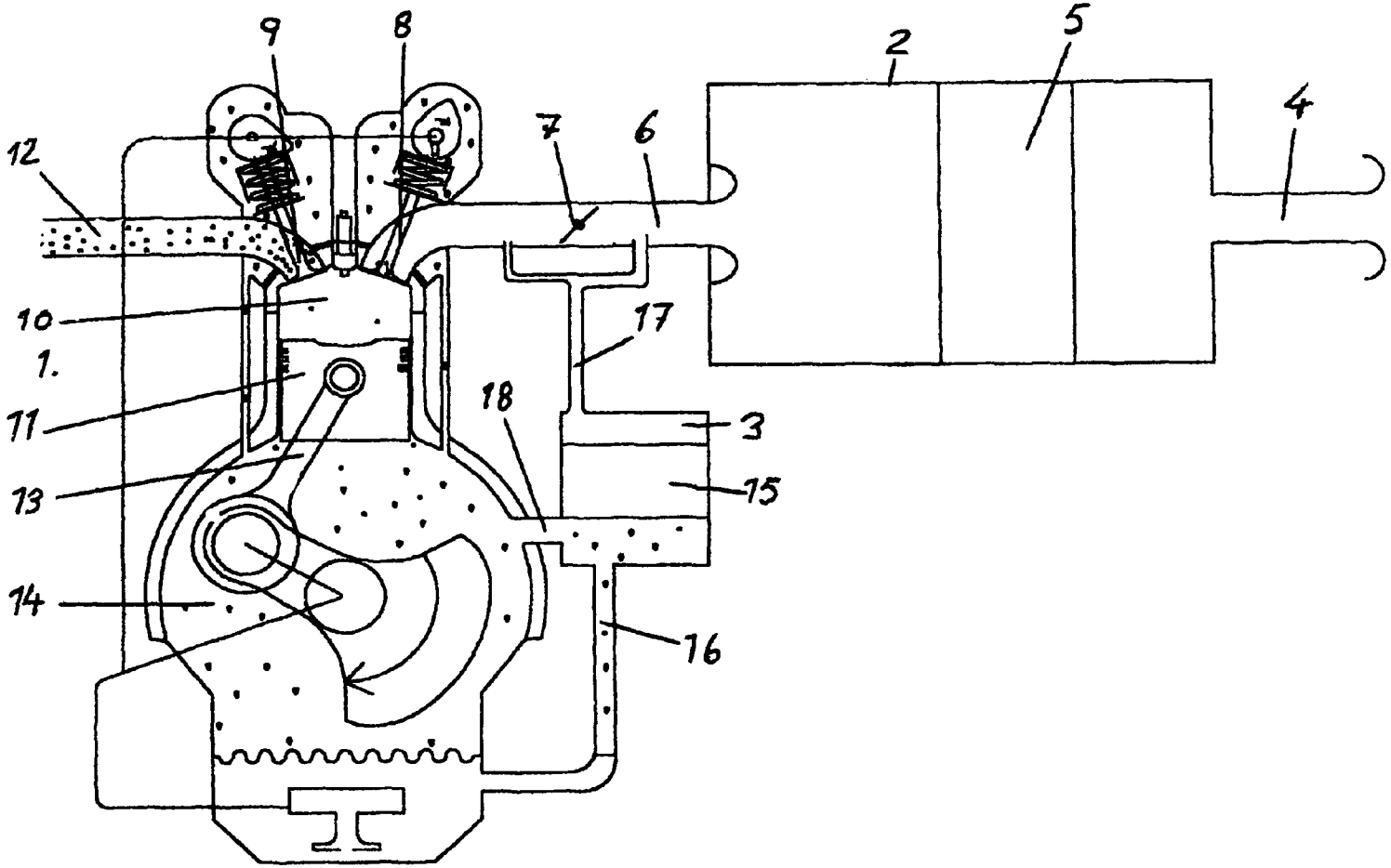
FIG. 1 shows an internal combustion engine with its associated filter and air intake.
Figure 4:
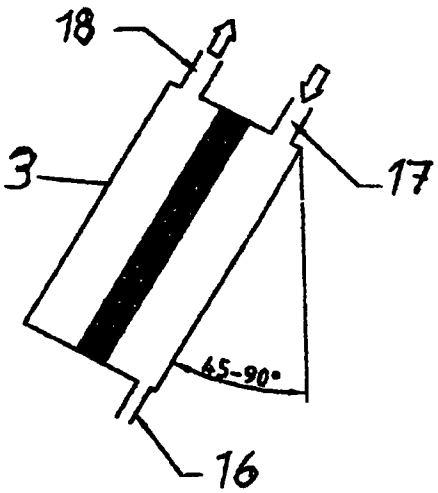
FIG. 4 shows an inclined filter unit.

FIG. 1 shows an internal combustion engine (1) with the thereto attached air intake (2) and a filter unit (3). The air intake has a passage (4) for outside air. This air has to pass through a filter (5) and is then fed into an inlet manifold (6). This has a damper (7). The inlet manifold (6) leads to a valve (8) on the engine's combustion chamber (10). Said combustion chamber has a further valve (9). A piston (11) operates inside the combustion chamber (10), which has an exhaust port (12). The piston (11) works in conjunction with a connecting rod (13) that operates inside a crankcase (14). As a rule, this contains oil. When the engine is running, contaminated air builds up to a high pressure in the crankcase. This air is evacuated, via a duct (18), to the filter unit (3). The filter unit (3) holds a filter cartridge (15), through which the air from the crankcase has to pass. Particles that have been filtered off are led away, through a conduit (16), to the crankcase. The cleaned air is led into the inlet manifold (6).

From this description of an internal combustion engine with the filter unit, it is clear that the contaminated air is completely cleaned by passage through the filter unit (3) and that, via a conduit (16), all the contaminants are led back into the crankcase.

Figure 3:
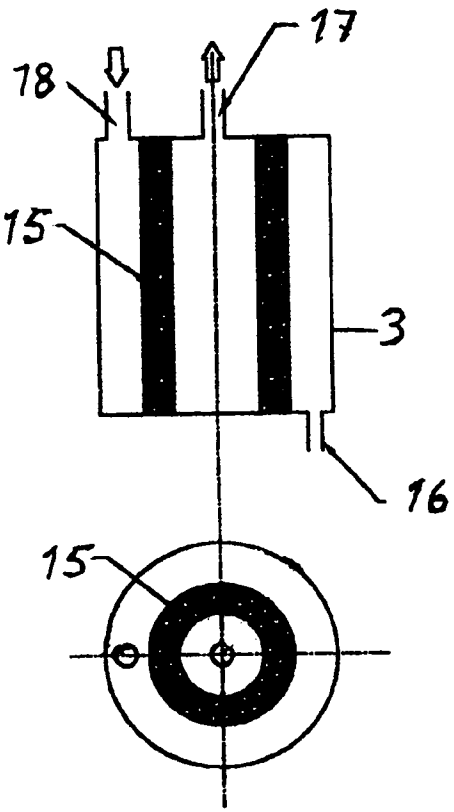
FIGS. 2 and 3 show two different models of a filter unit as per the present invention.
Figure 2:
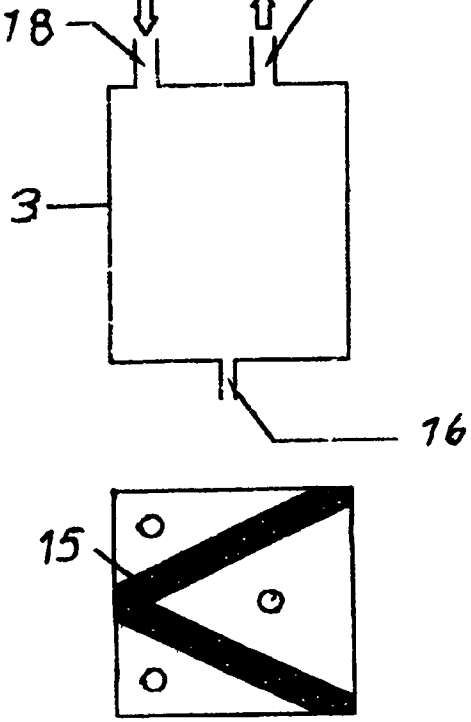

FIGS. 2 and 3 each show a filter unit design that has proven particularly advantageous for internal combustion engines.

FIG. 2 shows a filter unit seen from the side (top illustration) and from the top (bottom illustration). The filter unit has a parallelepipedic body. Contaminated air enters the filter unit (3) via a conduit (18). Cleaned air is evacuated from the filter (3) via another conduit (17). There is a drainage conduit (16) at the bottom of the filter unit (3). There are two walls (15) of fibrous material in the parallelepipedic cavity. These walls run from the top to the bottom of the body. Looking at the bottom illustration in FIG. 2, it is clear that the contaminated air enters at one side of the two depicted filter walls (15) and that the contaminated air has to pass transversally through both filter walls (15). Cleaned air exits the filter unit via conduit 17 on the other side of the two filter walls. Contaminants are led away through drainage conduit 16.

In FIG. 3, the body is cylindrical. It has a cylindrical filter wall (15) running between the top and the bottom of the body. Here, the contaminated air has to pass transversally through the cylindrical filter (15). Cleaned air is led off from the inside of this cylindrical filter (15). The contaminants are led away through drainage conduit 16.

It has proven particularly appropriate to have both the described filter unit models (FIGS. 2 and 3) positioned at an angle to the engine block. This has the advantage that it makes it easier for the contaminants separated from the air to reach the bottom of the filter unit.

In the same way, it has proven particularly appropriate in the foregoing for the filter unit to have fibre mats in which the fibres can have a diameter between 1 and 40 μm. Said fibres can be bonded to each other by, for example, needling or thermal bonding.

To have the desired effect, the fibrous material used can, of course, be arranged in a number of different ways.

It should also be obvious that the cleaning of contaminated air can occur in other situations similar to that arising in an internal combustion engine.

The invention claimed is:

1. A device for filtering particles from and reducing pressure of air that builds up in a crankcase of an operating internal combustion engine, the crankcase disposed adjacent a piston with an inlet manifold supplying filtered air to the piston, comprising:

a filter container of defined height having an upstream air inlet including means for connection to the crankcase to remove air under pressure and oil therefrom, a liquid outlet and a downstream air outlet including means for connection to the inlet manifold to supply filtered air thereto, the air outlet being disposed at a level above the liquid outlet; and a filter material comprising at least one cylinder of fibrous material running between upper and lower ends of the filter container over the entire height of the filter container, separating the container thereby into an inlet chamber comprising the inlet, and an outlet chamber comprising the air outlet, with the air passing transversely through the filter material, the fibrous material comprising needled or thermally bonded fibers;

the liquid outlet being disposed in a lower portion of the filter container separate from the air outlet, the inlet chamber receiving particles which fall from the filter material and oil from the crankcase to a defined depth, the liquid outlet comprising means for connection to the crankcase to return the oil and particles collected by the filter thereto, wherein a portion of the filter material extending from the defined depth to the upper end of the filter container presents a filter surface which is not contaminated by oil in the filter container.

2. Device as claimed in claim 1, wherein the filter container has a fixed position in relation to the internal combustion engine.

3. Device as claimed in claim 1, wherein the filter container has a predetermined angle in relation to the internal combustion engine.

4. Device as claimed in claim 1, wherein the fibrous material is comprised of fiber mats, in which the fibers have a diameter of 1-40 μm.

5. Device as claimed in claim 1, wherein the liquid outlet is in the inlet chamber.

6. In combination, an internal combustion engine including a crankcase disposed adjacent a piston with an inlet manifold supplying filtered air to the piston, and a device for filtering and reducing air pressure that builds up in a crankcase during operation of the engine, comprising:

a filter container of defined height having an upstream air inlet including means for connection to the crankcase to remove air under pressure and oil therefrom, a liquid outlet and a downstream air outlet including means for connection to the inlet manifold to supply filtered air thereto, the air outlet being disposed at a level above the liquid outlet; and a filter material comprising at least one cylinder of fibrous material running between upper and lower ends of the filter container over the entire height of the filter container, separating the container thereby into an inlet chamber comprising the inlet, and an outlet chamber comprising the air outlet, with the air passing transversely through the filter material, the fibrous material comprising needled or thermally bonded fibers;

the liquid outlet being disposed in a lower portion of the filter container separate from the air outlet, the inlet chamber receiving particles which fall from the filter material and oil from the crankcase to a defined depth, the liquid outlet comprising means for connection to the crankcase to return the oil and particles collected by the filter thereto, wherein a portion of the filter material extending from the defined depth to the upper end of the filter container presents a filter surface which is not contaminated by oil in the filter container.

7. The combination as claimed in claim 6, wherein the filter container has a fixed position in relation to the internal combustion engine.

8. The combination as claimed in claim 6, wherein the filter container has a predetermined angle in relation to the internal combustion engine.

9. The combination as claimed in claim 6, wherein the fibrous material is comprised of fiber mats, in which the fibers have a diameter of 1-40 μm.

10. The combination as claimed in claim 8, wherein the liquid outlet is in the inlet chamber.

* * * * *